US007096619B2

(12) United States Patent
Jackson et al.

(10) Patent No.: US 7,096,619 B2
(45) Date of Patent: Aug. 29, 2006

(54) EQUIPMENT OPERATOR PERSONALIZATION DEVICE

(76) Inventors: Charles L. Jackson, 5210 Edgemoor La., Bethesda, MD (US) 20814; Christopher S. Weaver, 13931 Esworthy Rd., Darnestown, MD (US) 20874

( * ) Notice: Subject to any disclaimer, the term of this patent is extended or adjusted under 35 U.S.C. 154(b) by 165 days.

(21) Appl. No.: 10/780,058

(22) Filed: Feb. 17, 2004

(65) Prior Publication Data

US 2005/0188583 A1 Sep. 1, 2005

(51) Int. Cl.
*F41A 17/06* (2006.01)

(52) U.S. Cl. ..... 42/70.11; 42/70.01

(58) Field of Classification Search ..... 42/70.01, 42/70.11

See application file for complete search history.

(56) References Cited

U.S. PATENT DOCUMENTS 4,488,370 A 12/1984 Lemelson
4,839,838 A 6/1989 LaBiche et al.
5,062,232 A 11/1991 Eppler
5,440,326 A 8/1995 Quinn
5,453,758 A 9/1995 Sato
5,461,812 A 10/1995 Bennett
5,515,032 A * 5/1996 Johnson ..... 340/571
5,758,524 A 6/1998 Yu
5,875,108 A 2/1999 Hoffberg
5,892,421 A 4/1999 Matsushima
5,898,421 A 4/1999 Quinn
6,081,750 A 6/2000 Hoffberg et al.
6,230,946 B1 5/2001 Vor Keller et al.
6,314,671 B1 11/2001 Gering
6,321,478 B1 11/2001 Klebes
6,408,905 B1 6/2002 Lee
6,412,207 B1 7/2002 Crye et al.
6,415,542 B1 7/2002 Bates
6,418,424 B1 7/2002 Hoffberg
6,429,769 B1 8/2002 Fulgeira
6,430,861 B1 8/2002 Ayers
6,442,880 B1 9/2002 Allan
6,481,138 B1 11/2002 Roca et al.
6,481,140 B1 11/2002 Marshall
6,494,368 B1 12/2002 Sapia
6,499,243 B1 12/2002 Herzog
6,510,639 B1 1/2003 McMoore
6,533,149 B1 3/2003 Vor Keller
6,563,940 B1 * 5/2003 Recce ..... 382/120
6,578,308 B1 6/2003 Hickerson
6,580,876 B1 6/2003 Gordon
6,588,635 B1 7/2003 Vor Keller
6,711,844 B1 * 3/2004 Rumfelt ..... 42/70.11
6,775,940 B1 * 8/2004 Dworzan et al. ..... 42/1.01
2001/0047488 A1 * 11/2001 Verplaetse et al. ..... 713/202

(Continued)

OTHER PUBLICATIONS

"False Hope fo the Smart Gun," Violence Policy Center, 1998; 5 pages.

(Continued)

*Primary Examiner*—Stephen M. Johnson
(74) *Attorney, Agent, or Firm*—24IP Law Group USA, PLLC; Timothy R. DeWitt

(57) ABSTRACT

A motion sensing device is embedded in a firearm. A processor in the firearm senses the pattern of motion of the firearm, and on sensing a specified sequence of motions, the processor permits operation of the firearm. The operator would move the firearm in a prescribed fashion to "unlock the gun." For example, the operator might trace out his or her initials with the muzzle of a pistol. Unlocking would stay valid until the operator released the gun handle or squeezed extra hard on the handle.

15 Claims, 2 Drawing Sheets

U.S. PATENT DOCUMENTS

| | | | | |
|---|---|---|---|---|
| 2002/0174588 | A1* | 11/2002 | Danner et al. | 42/70.09 |
| 2003/0097776 | A1 | 5/2003 | Brosow | |
| 2003/0098774 | A1 | 5/2003 | Chornenky | |

OTHER PUBLICATIONS

"The World's First Totally Electronic Handgun," Metal Storm Limited, 2003; 2 pages.

"Colt's Smart Gun," by Bill Clede, Law and Order, Feb. 1997; 4 pages.

"Meet the 'gun with brains,'" by Stuart Johnston, Popular Mechanics, Mar. 2003; 3 pages.

"'Smart Gun' May Be A Much Safer One," by David Lazarus, San Francisco Chronicle, Feb. 21, 2000; 3 pages.

"Justice Dept. reaches for 'smart' gun," by Sandeep Junnarkar, CNET News.com, Oct. 22, 2002 ; 2 pages.

* cited by examiner

EQUIPMENT OPERATOR PERSONALIZATION DEVICE

CROSS-REFERENCE TO RELATED APPLICATIONS

None.

STATEMENT REGARDING FEDERALLY SPONSORED RESEARCH OR DEVELOPMENT

Not applicable.

FIELD OF THE INVENTION

The invention is a means for securing a piece of hand-held equipment so that it is easily activated by an authorized user while, at the same time, individuals without proper authorization cannot easily active the equipment. The prototypical equipment to which the invention applies is a pistol or revolver. However the invention can also be applied to a wide range of human-operated equipment such as automobiles, airplanes, cell phones, PDAs, and snowmobiles.

BACKGROUND OF THE INVENTION

Firearm safety has been an issue almost as long as firearms have existed. In the last several years there has been interest in developing systems that permit only authorized users to operate firearms. Designs for such systems have included (1) special rings that, when in close proximity to the firearm, permit operation of the firearm, and (2) systems that scan the fingerprint or other biomechanical marker and permit authorized users, whose physical characteristics have been pre-entered into the authorization system, to use the firearm. Examples of proposed designs having a ring or other transmitter in the vicinity of the firearm include U.S. Pat. No. 4,488,370 to Lemelson, U.S. Pat. No. 5,461,812 to Bennett, or published U.S. patent application No. 20030097776. Another example is U.S. Pat. No. 5,062,232 to Eppler, which proposes a glove to be worn by the user. An example of a biometric type of system would be published U.S. Patent Application No. 20030098774. Each of these patents and patent applications are hereby incorporated by reference.

Similarly, a variety mechanisms, notably key and lock systems, are used to authorize operation of automobiles, airplanes, electrical generators, etc.

Although some of these prior mechanisms may have provided some measure of security or safety, they are inconvenient and suffer from serious drawbacks in their operation.

SUMMARY OF THE INVENTION

The present invention provides a new and different security mechanism that can be personalized by one or more authorized users without the inconvenience of requiring separate equipment such as a transmitter ring or key.

A system for authorizing use of equipment comprising a motion sensor for sensing a movement of the equipment, a processor connected to an output of the motion sensor for analyzing a movement of the equipment, an energy source connected to the motion sensor and the processor, and an operation enablement subsystem connected to the processor for enabling operation of the equipment in response to a signal from the processor.

The system may be adapted, for example, for use on a firearm. In such an example, the motion sensor may be located on the barrel of the firearm but may be located elsewhere. The processor may be located in the handle of the firearm, but, like the motion sensor, may be located elsewhere. The motion sensor may be, for example, one or more accelerometers.

Aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the architecture and method, given only by way of example, and with reference to the accompanying drawings, in which.

DESCRIPTION OF THE PREFERRED EMBODIMENTS

Figure 1:
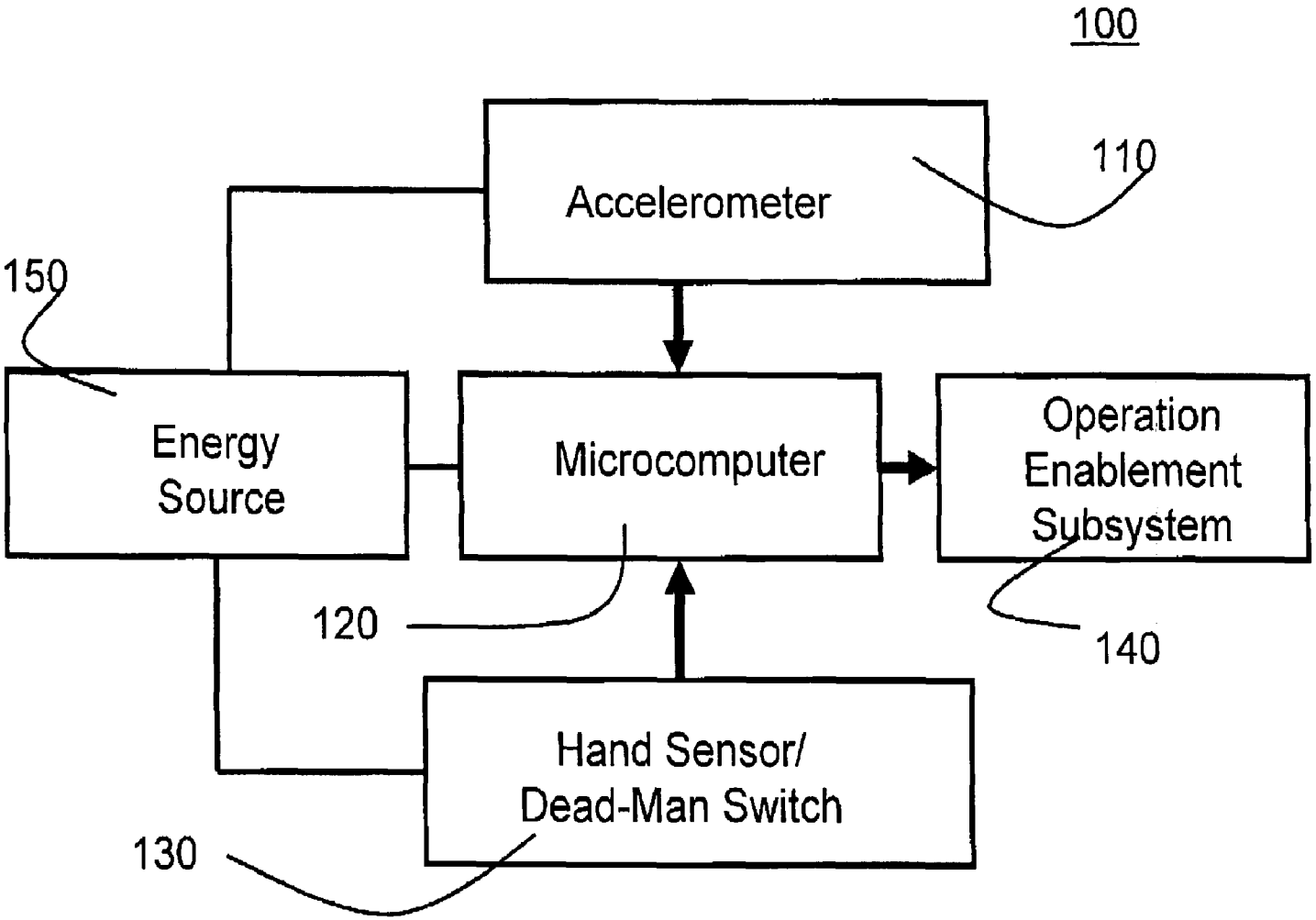
FIG. 1 is an overall diagram of the system, showing the major subsystems and their interconnection.
Figure 2:
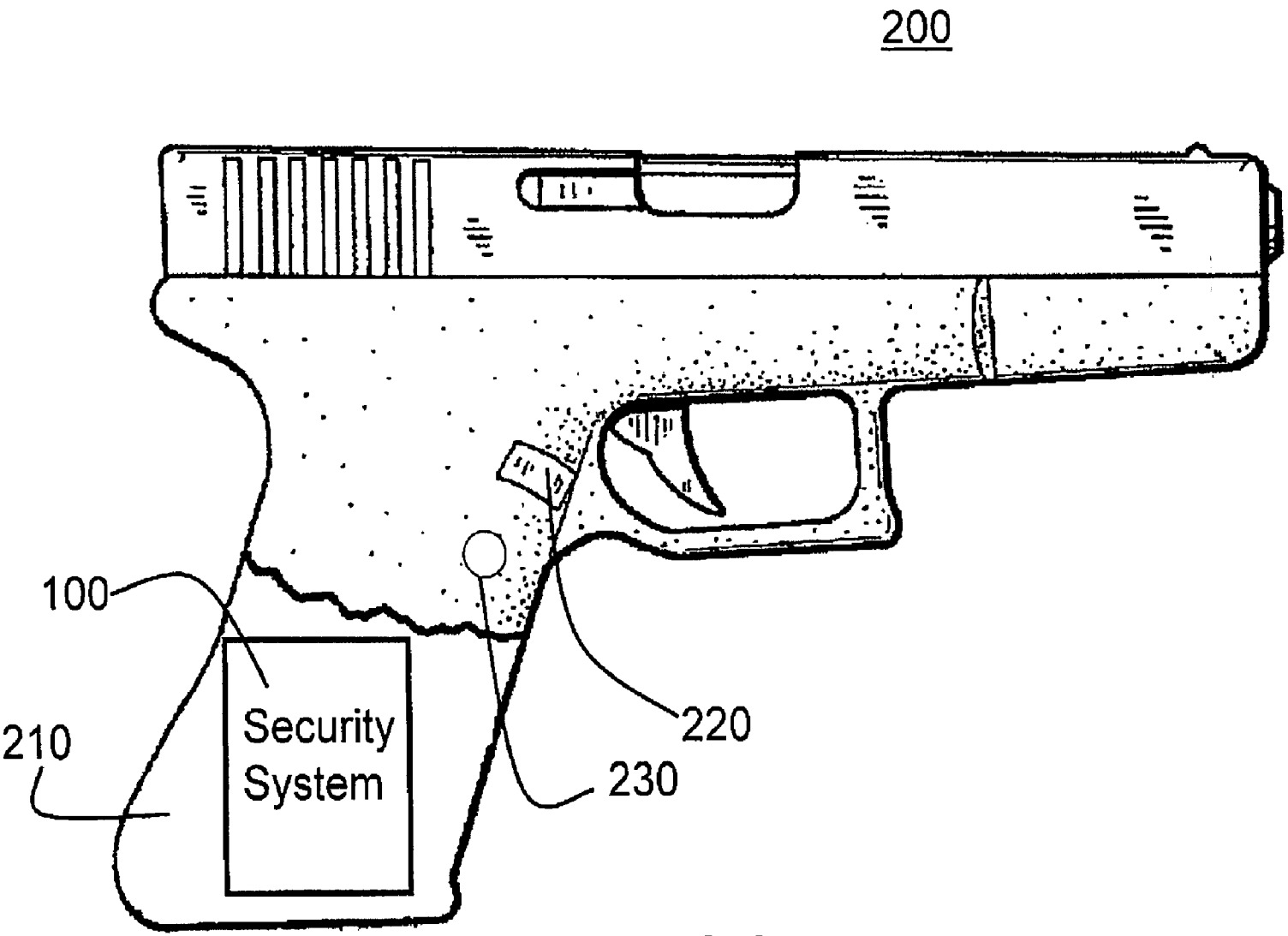
FIG. 2 is a diagram of a preferred embodiment of the invention in a handgun.

The present invention may apply to any type of hand-held equipment that may be moved in prescribed patterns by an operator prior to use. For purposes of clarity of description, however, the preferred embodiments will be described in the context of hand-held firearms such as a pistol or revolver 200. The use of electronics to control such firearms has been disclosed, for example, in U.S. Pat. No. 6,430.861, which is hereby incorporated by reference. Those of skill in the art should understand that the invention is equally applicable to other types of devices such as cell phones, radios, or PDA's.

In a preferred embodiment of the invention, a motion sensing device, such as an accelerometer, is embedded in a firearm. The motion sensing device may be placed on, attached to, or incorporated into any portion of the firearm, although placement of the motion-sensing device on the barrel of the firearm is preferred in this example. A processor in the firearm senses a pattern or patterns of motion of the firearm, and on sensing a specified sequence of motions, the processor permits operation of the firearm. The processor, could be placed in the same vicinity of the firearm as the accelerometer or could be placed, for example, in the handle 210 of the device.

The operator would move the firearm in a prescribed fashion to "unlock the gun." For example, the operator might trace out his or her initials with the muzzle of a pistol. Unlocking would stay valid until some prescribed event, such as the operator releasing the gun handle, squeezing extra hard on the handle, or performing a second specified sequence of motions. The unlocking effect likewise could remain valid for some prescribed period of time.

Alternatively, the prescribed pattern motions might be a series of elementary motions (sharp right, sharp right, forward). Choosing only simple motions in each of the three directions (up/down, left/right, forward/back) and the use of only three motions in an unlocking combination yields $6^3=216$ combinations. While a combination lock with only 216 combinations would not provide useful security, a set of 216 combinations would pose a substantial impediment to some who seized a firearm from a police officer and wished to use the firearm immediately to injure or to threaten others.

Alternatively, a more complex set of steps could be used for authorization—pauses, intensity of motion, combinations of motions (e.g., down and left), and duration of motion could also be included. Staying with the six basic directions but permitting the additional complexity of brief and long pauses, fast and slow motions, and brief and longer motions gives 26 basic motions (e.g., left-fast-short, right-slow-long). There are about 17,000 combinations of three such movements and about one-half million combinations of four such movements. Clearly, this invention permits a wide tradeoff between the complexity of the authorizing motions and the possibility that an unauthorized user could activate the device.

In a preferred embodiment as shown in FIG. 1, the system 100 would comprise a 3-axis accelerometer 110 with digital output; a microcomputer or processor 120 for processing the output of the accelerometer; a sensor 130 (conductive or pressure sensitive) to verify that the user's hand remains in contact with the handle of the firearm; a source of stored electrical energy such as a battery 150; and an operation enablement subsystem 140.

Alternatively, instead of the 3-axis accelerometer, there could be a 2-axis accelerometer or a 1-axis accelerometer or a combination of multiple accelerometers. Moreover, a true accelerometer could be replaced with a simplified on-off accelerometer—a system capable of detecting when acceleration in a specified direction exceeded a given level. (This could be a weight+spring+switch subsystem).

The output of the accelerometer or accelerometers would be fed into the processor or microcomputer 120. The processor would match the sequence of motions indicated with the pre-stored authorization sequence or sequences. On sensing an authorizing sequence, the processor would permit operation of the firearm. For example, the processor could energize a solenoid that would interpose a linking bar between the hammer and the firing pin.

Alternatively, the firearm could use an electrical ignition system—sending an electrical current through the primer in the cartridge. In this alternative, a digital input from the trigger mechanism would flow to the processor, signaling the processor whenever the trigger was pulled. On sensing a trigger pull, the processor would then check the authorization state of the firearm, and when properly authorized transmit the ignition current.

A second sensor may be attached to the firearm to detect when the firearm is in an operator's hand and ready to be activated. This sensor would send a signal to the processor indicating that the firearm was being held by a potential operator. Alternatively, this sensor could be used to energize the processor—the sensor could be as simple as an on-off switch that was activated when the user wrapped his or her hands around the handle of a pistol.

The processor would not permit the firearm to be discharged if the user released his or her grip on the firearm for a period of time sufficiently long for the firearm to be transferred to the grip of a second person. The processor might be programmed to tolerate grip releases as long as 50 milliseconds but to require reactivation of the firearm if the user's grip were released for longer than 50 milliseconds. Alternatively, in order to permit a wide range of handling options, the processor might be programmed to require reactivation only if the user's grip were released for longer than 5 seconds.

The pattern or patterns of movement necessary to activate the firearm could be set in a variety of ways. The system could allow for an authorized user to program a particular movement or pattern of movement to activate the firearm. For example, the firearm could include a PROGRAM mode in which a user could move the weapon in a chosen pattern and the system would start the particular movement or pattern of movements in a memory. In this way, a simple firearm could be program to operate in response to a plurality of patterns such that more than one user, such a police officer and his or her partner, could be authorized users of a single weapon.

The system could be placed into PROGRAM mode in a secure manner, such as through a connection, wired or wireless, to a processor that uses an encryption key to place the system into the desired mode.

The system could include a sleep mode in which the processor and all associated electronics were turned off for a period of 90 milliseconds. A timer, using minimal stored electricity, would activate the processor for a period of 1 millisecond. The processor would examine the outputs of the accelerometers, and if it found that the firearm was in an operator's hand and in the initial motion of an authorizing sequence, would send a signal that would activate the power for a longer period of time. Alternatively, if the processor did not sense such motion, it would return to the sleep mode. Such a sleep mode would permit the system to be effectively available at all times while consuming battery energy at a reduced rate—thus permitting long battery life.

In another embodiment, the power to the system could be turned off when a mechanical safety 220 on the firearm is engaged and turned on only when the mechanical safety on the firearm is disengaged.

The system could be designed to go into either an operational state after a battery ran down or to become inoperational after a battery ran down. The choice between the two alternatives depends on the relative costs of denying operation to authorized users and permitting use by unauthorized users. The system additionally could include an indicator 230 that depicts the battery level, or an indicator tat is activated only when the battery level goes below a certain threshold. The system likewise could include the ability to recharge the battery or batteries at a convenient time or location for the user.

The firearm might have one or more indicators to show that the firearm has accepted an authorization and/or that the battery is properly charged.

Although the invention has been defined in terms of the authorization of the use of a firearm, the invention can also be applied to the authorization of the use of handheld electronics devices such as personal processors, wireless phones, and PDAs, or handheld tools such as a nail gun.

While the foregoing invention has been described in terms of its preferred embodiments, it should be understood that various modifications may be made thereto without departing from the spirit and scope of the invention as defined in the appended claims. It is intended that all such modifications fall within the scope of the appended claims.

What is claimed is:

1. A system for authorizing the operation of equipment comprising:

a motion sensor for sensing a motion said equipment;

a processor connected to an output of said motion sensor, said processor having an energy-conserving state and an active state;

an energy supply subsystem connected to said motion sensor and said processor;

an operation enablement subsystem;

a switch; and means for deactivating said system;

wherein, said energy supply subsystem periodically applies energy to said processor when said processor is in said energy-conserving state, and when said energy is applied said processor determines whether an activation sequence is beginning based upon a state of said switch and an output of said motion sensor.

2. The system of claim 1 wherein said motion sensing device comprises an accelerometer.

3. The system of claim 2 wherein said accelerometer comprises a 3-axis accelerometer.

4. A system according to claim 1 wherein said switch comprises a pressure activated electrical switch.

5. A system according to claim 1 wherein said switch comprises a conductive sensor.

6. A system according to claim 1 wherein said equipment comprises a firearm.

7. The system of claim 1 wherein said motion sensing device comprises an accelerometer.

8. The system of claim 7 wherein said accelerometer comprises a 3-axis accelerometer.

9. A system according to claim 1 wherein said operation enablement system comprises an electronic firing system.

10. A system according to claim 1 further comprising a mechanical safety; wherein said energy supply subsystem provides energy to said processor only when said mechanical safety is disengaged.

11. A system according to claim 1 further comprising a mechanical safety; wherein said energy supply subsystem provides energy to said motion sensor only when said mechanical safety is disengaged.

12. A system according to claim 1 wherein said energy supply subsystem comprises a battery.

13. A system according to claim 1 wherein upon a determination that an activation sequence is beginning, said processor establishes full power until said means for deactivating deactivates said system.

14. A system according to claim 1 further comprising an indicator for indicating to the operator that operation of the equipment has been authorized.

15. A system according to claim 14 wherein said indicator comprises a light.

* * * * *